US012807197B2

(12) United States Patent
Hur et al.

(10) Patent No.: US 12,807,197 B2
(45) Date of Patent: Nov. 24, 2026

(54) SYSTEM AND METHOD FOR ESTIMATING TRACK CURVATURE FOR ACTIVE STEERING CONTROL OF RAILCARS

(71) Applicant: KOREA RAILROAD RESEARCH INSTITUTE, Uiwang-si (KR)

(72) Inventors: Hyun Moo Hur, Uiwang-si (KR); Jung Won Seo, Seongnam-si (KR); Kyung Ho Moon, Seoul (KR)

(73) Assignee: KOREA RAILROAD RESEARCH INSTITUTE, Uiwang-si (KR)

( * ) Notice: Subject to any disclaimer, the term of this patent is extended or adjusted under 35 U.S.C. 154(b) by 0 days.

(21) Appl. No.: 18/919,623

(22) Filed: Oct. 18, 2024

(65) Prior Publication Data

US 2025/0162626 A1 May 22, 2025

(30) Foreign Application Priority Data

Nov. 16, 2023 (KR) ..... 10-2023-0158865

(51) Int. Cl.

| | |
|---|---|
| ***B61F 5/38*** | (2006.01) |
| ***B61L 15/00*** | (2006.01) |
| ***B61L 25/02*** | (2006.01) |

(52) U.S. Cl.

CPC ..... *B61F 5/383* (2013.01); *B61L 15/0072* (2013.01); *B61L 25/021* (2013.01)

(58) Field of Classification Search

CPC . B61F 5/38–48; B61L 15/0072; B61L 25/021
See application file for complete search history.

(56) References Cited

U.S. PATENT DOCUMENTS 11,679,792 B2 * 6/2023 Ersch ..... B61L 27/53 246/120

FOREIGN PATENT DOCUMENTS

JP H0220750 U * 2/1990
JP 2004161115 A * 6/2004
(Continued)

OTHER PUBLICATIONS

Matsumoto, JP 2004-161115, machine translation. (Year: 2004).*
Hur, KR 20110061056, machine translation. (Year: 2011).*

*Primary Examiner* — Mark L. Greene
(74) *Attorney, Agent, or Firm* — STIP Law Group, LLC

(57) ABSTRACT

Provided are a system and method for estimating a track curvature for active steering control of railcars which are configured to estimate a front-back-direction relative angle between a front bogie and a rear bogie of a lead car from a relative displacement measured by displacement sensors, which are installed on the front and rear bogies of two cars to measure a displacement between the front and rear bogies, calculate an estimated value of a track curvature radius R using an equation $$R = \frac{2Lx}{\Delta},$$

calculate a travel distance of the lead car on the basis of speed data measured by a speed sensor, which measures a travel speed of the lead car, to specify the location of a following car in accordance with a car length, and then map the estimated track curvature radius value data to the following car location to transmit estimated track curvature radius value data to an active steering control unit of the following car.

4 Claims, 13 Drawing Sheets

(56) References Cited

FOREIGN PATENT DOCUMENTS

| | | | | | |
|---|---|---|---|---|---|
| KR | 20110061056 | A | * | 6/2011 | ..... B61K 9/08 |
| KR | 101084157 | B1 | | 11/2011 | |

* cited by examiner

FIG. 8

SIZE OF D : 5

| LEAD CAR | | | FOLLOWING CAR 1 | |
|---|---|---|---|---|
| distance 1 | distance 1+D | curvature 1 | distance 2 | curvature 2 |
| 0 | 5 | 0 | 0 | 0 |
| 1 | 6 | 0 | 1 | 0 |
| 2 | 7 | 0 | 2 | 0 |
| 3 | 8 | 0 | 3 | 0 |
| 4 | 9 | 1 | 4 | 0 |
| 5 | 10 | 2 | 5 | 0 |
| 6 | 11 | 3 | 6 | 0 |
| 7 | 12 | 4 | 7 | 0 |
| 8 | 13 | 5 | 8 | 0 |
| 9 | 14 | 5 | 9 | 1 |
| 10 | 15 | 5 | 10 | 2 |
| 11 | 16 | 5 | 11 | 3 |
| 12 | 17 | 4 | 12 | 4 |
| 13 | 18 | 3 | 13 | 5 |
| 14 | 19 | 2 | 14 | 5 |
| 15 | 20 | 1 | 15 | 5 |
| 16 | 21 | 0 | 16 | 5 |
| 17 | 22 | 0 | 17 | 4 |
| 18 | 23 | 0 | 18 | 3 |
| 19 | 24 | 0 | 19 | 2 |
| 20 | 25 | 0 | 20 | 1 |
| 21 | 26 | 0 | 21 | 0 |
| 22 | 27 | 0 | 22 | 0 |
| 23 | 28 | 0 | 23 | 0 |
| 24 | 29 | 0 | 24 | 0 |
| 25 | 30 | 0 | 25 | 0 |
| 26 | 31 | 0 | 26 | 0 |
| 27 | 32 | 0 | 27 | 0 |

(a)

(b)

SYSTEM AND METHOD FOR ESTIMATING TRACK CURVATURE FOR ACTIVE STEERING CONTROL OF RAILCARS

CROSS-REFERENCE TO RELATED APPLICATION

This application claims the priority of the Korean Patent Application NO 10-2023-0158865, filed on Nov. 16, 2023, in the Korean Intellectual Property Office. The entire disclosures of all these applications are hereby incorporated by reference.

BACKGROUND

1. Field of the Invention

The present invention relates to active steering control of railway bogie, and more particularly, to a system and method for estimating a track curvature for active steering control of railcars which are configured to estimate a front-back-direction relative angle between a front bogie and a rear bogie of a lead car from a relative displacement measured by displacement sensors, which are installed on the front and rear bogies of two cars to measure a displacement between the front and rear bogies, calculate an estimated value of a track curvature radius R using an equation $$R = \frac{2Lx}{\Delta},$$

calculate a travel distance of the lead car on the basis of speed data measured by a speed sensor, which measures a travel speed of the lead car, to specify a location of a following car in accordance with a car length, and then map the estimated track curvature radius value data to the location of the following car to transmit the mapped data to an active steering control unit of the following car.

2. Discussion of Related Art

In general, wheels of a train have a tapered cross-sectional shape that increases in diameter outward in a width direction of a car. Accordingly, when the train slants to one side in the width direction due to inertia while running on a curved track, even if no separate steering device is provided, contact positions of left and right wheel treads with rails of the track are shifted to make a difference in travel distance between the left and right wheels while diameters of the left and right wheels are changed, which is manual steering.

However, manual steering has a disadvantage that wheels and rails wear out quickly, increasing the maintenance cost of tracks and trains and degrading the travel stability of trains. Accordingly, as disclosed in Korean Patent Publication No. 10-1084157 (registered on Nov. 10, 2011), there is an increasing application of active steering control device that may estimate a track curvature radius when a train travels on a curved section of the track and adjust wheelset steering angles of bogies to reduce an attack angle, which is an angle between the track and a wheelset, and improve travel stability.

In the above active steering control system, when each railcar of a train is equipped with a detection device to detect a track curvature radius, the cost of building the active steering control system may increase significantly. Accordingly, only a lead car which is at the forefront in a train's travel direction is equipped with a curvature radius detection device.

Since a track is constructed with a uniform curvature of radius, a radius of curvature of a curved runway track measured at a lead car is estimated as a radius of curvature of a curved runway track on which the following car is running for active steering of bogies of the following car connected to the rear end of the lead car, and an active steering control device of the following car performs active steering control on the basis of the radius of curvature measured at the lead car.

Due to a structural characteristic of a train that a plurality of railcars are connected at regular intervals in a track length direction, there is a time delay between a lead car and a following car passing through the same point on a curved runway track. Accordingly, the curvature radius data used for active steering control of the lead car is applied as the curvature radius data used for active steering control of the following car with a certain time delay as shown in FIG. 1, and the delay time of the curvature radius data is determined on the basis of a travel speed of the train.

However, when a curvature radius data delay time between active steering control devices of preceding and following cars is determined on the basis of a travel speed of the train, the amount of time delay may drastically change during a process in which the train approaches stop state speed while departing or stopping as shown in FIG. 2, and the time delay may become unstable.

Therefore, a delay error may occur due to the instability of a delay time of curvature radius data between preceding and following cars for active steering control, resulting in a difference between an estimated curvature radius value which is applied to active steering control of the following car and an actual radius of curvature of a curved runway track. This may degrade travel stability or lead to an accident such as derailment or the like.

RELATED ART DOCUMENTS

Patent Documents

Korean Patent Publication No. 10-1084157 (registered on Nov. 10, 2011)

SUMMARY OF THE INVENTION

The present invention is directed to providing a system for estimating a track curvature for active steering control of railcars which prevents the degradation of travel stability or accidents, such as derailment and the like, by preventing a delay error from occurring due to the instability of a delay time of curvature radius data between preceding and following cars for active steering control in the case of applying curvature radius data used for active steering control of the preceding car for active steering control of the following car.

According to an aspect of the present invention, there is provided a system for estimating a track curvature for active steering control of railcars, the system including displacement sensors installed on a front bogie and a rear bogie of a lead car in a train's travel direction and configured to measure a car-front-back-direction relative displacement between the front bogie and the rear bogie between which a relative angle is formed due to a curved sectional track, speed sensors configured to measure a travel speed of the lead car, a calculation unit configured to receive the displacement data measured by the displacement sensors, estimate a front-back-direction relative angle between the front bogie and the rear bogie of the lead car from the measured relative displacement, calculate an estimation value of a track curvature radius R using an equation $$R = \frac{2Lx}{\Delta},$$

(2L: a distance between a center of the front bogie and a center of the rear bogie, x: a separation distance of the displacement sensors from the centers of the front bogie and the rear bogie in a car width direction, and Δ: a sum of a separation distance $\Delta_1$ of the displacement sensor from the center of the front bogie in a car front-back direction and a separation distance $\Delta_2$ of the displacement sensor from the center of the rear bogie in the car front-back direction), and calculate a travel distance of the lead car on the basis of the speed data measured by the speed sensors, active steering control units installed in a front bogie and a rear bogie of each railcar, and a data mapping unit configured to specify an $n^{th}$ following car's location of D×n in accordance with a car length of D on the basis of the travel distance calculated by the calculation unit, map the track curvature radius estimation value data measured at the lead car to following cars' specified locations at intervals of D×n, and then transmit the mapped track curvature radius estimation value to the active steering control units of the following cars.

The speed sensors may measure the travel speed of the car from numbers of wheel rotations of the front bogie and the rear bogie of the lead car, and the calculation unit may use an average of a speed measured by the speed sensor of the front bogie and a speed measured by the speed sensor of the rear bogie as the speed data to calculate the travel distance of the lead car.

According to another aspect of the present invention, there is provided a system for estimating a track curvature for active steering control of railcars, the system including a displacement sensor which is a Global Positioning System (GPS) receiver installed at a center of a front bogie of a lead car in a train's travel direction, and configured to measure a travel path and a travel speed of the center of the front bogie running on a curved sectional track in real time, a calculation unit configured to estimate a travel path of a center of a rear bogie on the basis of the travel path of the center of the front bogie measured by the displacement sensor and a separation distance between the center of the front bogie and the center of the rear bogie of the lead car, calculate an estimation value of a track curvature radius R using an equation $$R = \frac{\Delta^2 + L^2}{2\Delta}($$

(L: half the distance between the center of the front bogie and the center of the rear bogie, and Δ: a maximum distance from a virtual line segment between the center of the front bogie and the center of the rear bogie to the travel path of the center of the front bogie), and calculate a travel distance of the lead car on the basis of the speed data measured by the displacement sensor, active steering control units installed in a front bogie and a rear bogie of each railcar, and a data mapping unit configured to specify an $n^{th}$ following car's location of D×n in accordance with a car length of D on the basis of the travel distance calculated by the calculation unit, map the track curvature radius estimation value data measured at the lead car to following cars' specified locations at intervals of D×n, and then transmit the mapped track curvature radius estimation value to the active steering control units of the following cars.

According to another aspect of the present invention, there is provided a method of estimating a track curvature for active steering control of railcars, the method including a relative displacement measurement process in which displacement sensors installed on a front bogie and a rear bogie of a lead car in a train's travel direction measures a car-front-back-direction relative displacement between the front bogie and the rear bogie between which a relative angle is formed due to a curved sectional track, a speed measurement process in which a speed sensor measures a travel speed of the lead car, a track curvature radius estimation process in which a calculation unit estimates a front-back-direction relative angle between the front bogie and the rear bogie of the lead car from the displacement data received from the displacement sensors and then calculates an estimation value of a track curvature radius R using an equation $$R = \frac{2Lx}{\Delta}($$

(2L: a distance between a center of the front bogie and a center of the rear bogie, x: a separation distance of the displacement sensors from the centers of the front bogie and the rear bogie in a car width direction, and Δ: a sum of a separation distance $\Delta_1$ of the displacement sensor from the center of the front bogie in a car front-back direction and a separation distance $\Delta_2$ of the displacement sensor from the center of the rear bogie in the car front-back direction), a travel distance calculation process in which the calculation unit calculates a travel distance of the lead car on the basis of the speed data measured by the speed sensor, a following car location specification process in which a data mapping unit specifies an $n^{th}$ following car's location of D×n in accordance with a car length of D on the basis of the travel distance calculated by the calculation unit, a track curvature radius data mapping process of mapping the track curvature radius estimation value data measured at the lead car to following cars' specified locations at intervals of D×n, a mapping data transmission process of transmitting the mapped track curvature radius estimation value to active steering control units installed in a front bogie and a rear bogie of each railcar, and an active steering control process of separately controlling the active steering control units of each car on the basis of the mapped track curvature estimation value.

In the speed measurement process, the speed sensor may measure the travel speed of the car from numbers of wheel rotations of the front bogie and the rear bogie of the lead car, and in the travel distance calculation process, the calculation unit may calculate the travel distance of the lead car on the basis of travel speed data acquired from an average of a speed measured by the speed sensor of the front bogie and a speed measured by the speed sensor of the rear bogie.

According to another aspect of the present invention, there is provided a method of estimating a track curvature for active steering control of railcars, the method including a front-bogie travel path and speed measurement process in which a displacement sensor which is a GPS receiver installed at a center of a front bogie of a lead car in a train's travel direction measures a travel path and a travel speed of the center of the front bogie running on a curved sectional track in real time, a rear-bogie travel path estimation process in which a calculation unit estimates a travel path of a center of a rear bogie on the basis of the travel path of the center of the front bogie measured by the displacement sensor and a separation distance between the center of the front bogie and the center of the rear bogie of the lead car, a track curvature radius estimation process of calculating an estimation value of a track curvature radius R using an equation $$R = \frac{\Delta^2 + L^2}{2\Delta}($$

(L: half the distance between the center of the front bogie and the center of the rear bogie, and Δ: a maximum distance from a virtual line segment between the center of the front bogie and the center of the rear bogie to the travel path of the center of the front bogie) on the basis of the estimated travel path of the center of the rear bogie, a travel distance calculation process in which the calculation unit calculates a travel distance of the lead car on the basis of the speed data measured by the displacement sensor, a following car location specification process in which a data mapping unit specifies an $n^{th}$ following car's location of D×n in accordance with a car length of D on the basis of the travel distance calculated by the calculation unit, a track curvature radius data mapping process of mapping the track curvature radius estimation value data measured at the lead car to following cars' specified locations at intervals of D×n, a mapping data transmission process of transmitting the mapped track curvature radius estimation value to active steering control units installed in a front bogie and a rear bogie of each railcar, and an active steering control process of separately controlling the active steering control units of each car on the basis of the mapped track curvature estimation value.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIGS. 8 and 9 are a table and a set of graphs showing delay of curvature radius data made by a distance delay between a preceding car and a following car in a system for estimating a track curvature for active steering control of railcars according to the present invention;

DETAILED DESCRIPTION OF EXEMPLARY EMBODIMENTS

Figure 1:
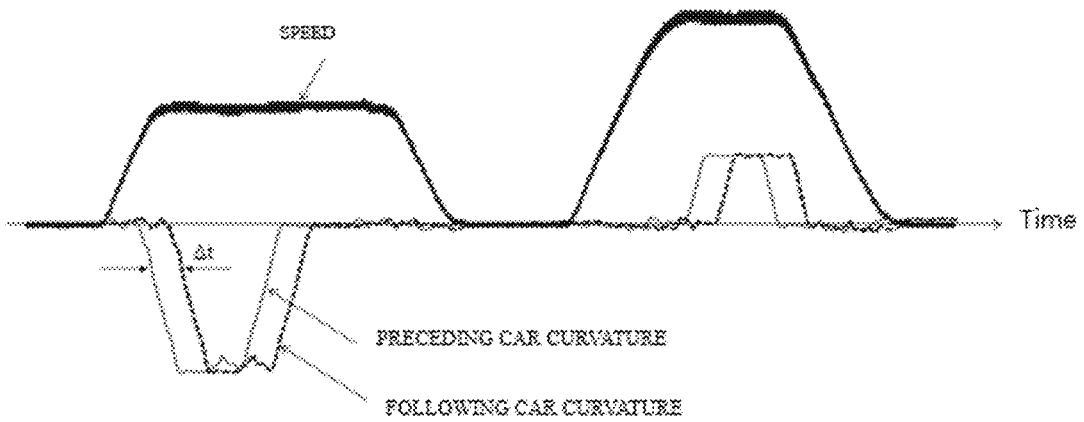
FIGS. 1 and 2 are graphs illustrating an example of utilizing curvature radius data of a curved running track acquired from a preceding car as curvature radius data of a curved running track for active steering control of a following car according to a time delay method of the related art.

Hereinafter, exemplary embodiments of the present invention will be described in detail with reference to the accompanying drawings.

The exemplary embodiments will be described in detail, focusing on parts necessary to understand operations and effects related to the present invention.

In describing the exemplary embodiments of the present invention, description of technology that is well known in the technical field to which the present invention pertains and is not directly related to the present invention will be omitted.

This is intended to clearly convey the subject matter of the present invention without obscuring it.

Also, in describing components of the present invention, different reference numerals may be given to components with the same name in different drawings, or the same reference numeral may be given in different drawings.

Even in this case, it does not mean that corresponding components have different functions in different embodiments or have the same function in different embodiments. Rather, a function of each component is determined on the basis of description of the component in a corresponding embodiment.

Unless particularly defined otherwise, technical terms used herein should be construed as generally understood by those of ordinary skill in the art to which the present invention pertains, and should not be construed as having an overly comprehensive meaning or overly reduced meaning.

As used herein, singular expressions include plural expressions unless the context indicates otherwise.

In this specification, the terms "comprise," "comprising," "include," "including," "have," "having," and the like should not be construed as necessarily including all components or operations described herein. Some components or operations may not be included, or additional components or operations may be further included.

Figure 3A:
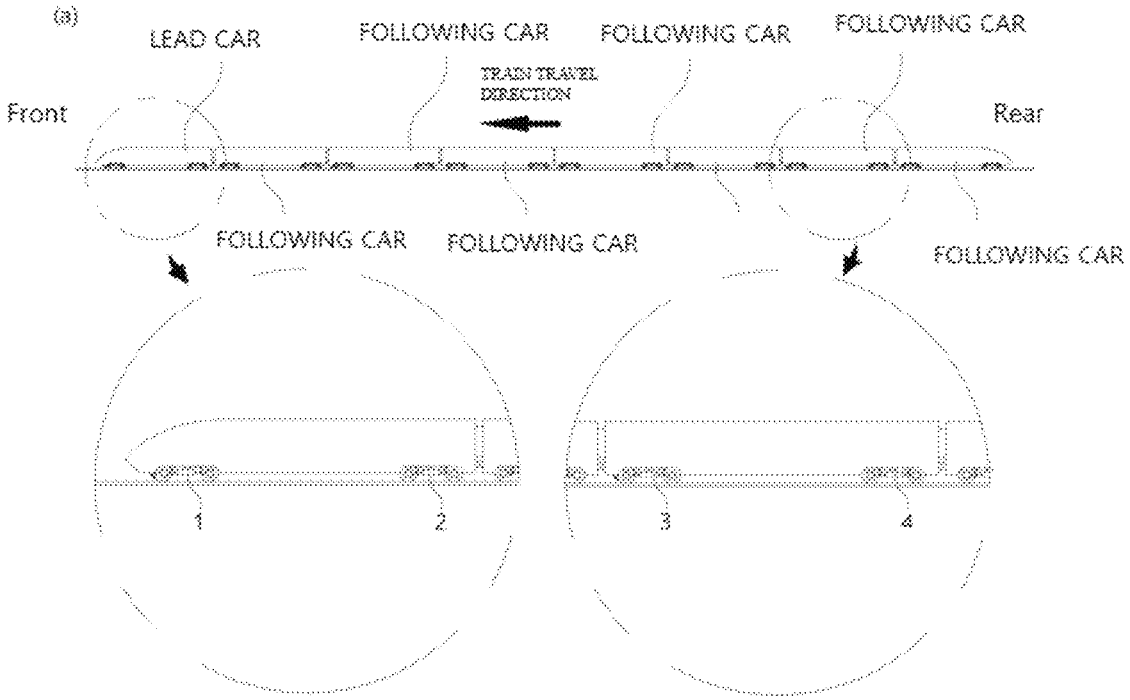
FIG. 3(*a*), FIG. 3(*b*) are a set of diagrams showing a positional relationship between a lead car and a following car in a travel direction in a system for estimating a track curvature for active steering control of railcars according to the present invention.
Figure 3B:
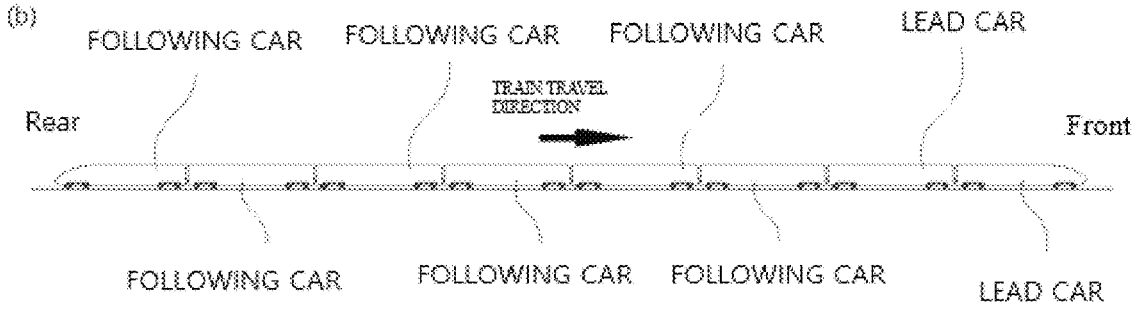

As shown in FIG. 3, a system for estimating a track curvature for active steering control of railcars according to the present invention is configured to estimate a track curvature radius measured at a lead car in a train's travel direction as a track curvature of a curved runway, on which following cars connected to the rear end of the lead car pass, to perform active steering control.

In this way, a track curvature detection sensor which is usually installed in each railcar constituting a train is only installed in a lead car of a train, which can reduce a cost of building a system for estimating a track curvature for active steering control of railcars.

In the specification of the present invention, a lead car is the forefront railcar in a train travel direction. Accordingly, as shown in FIG. 3, even the last following railcar of a train which travels in one direction may become the foremost railcar when the train travels in the opposite direction.

Figure 5:
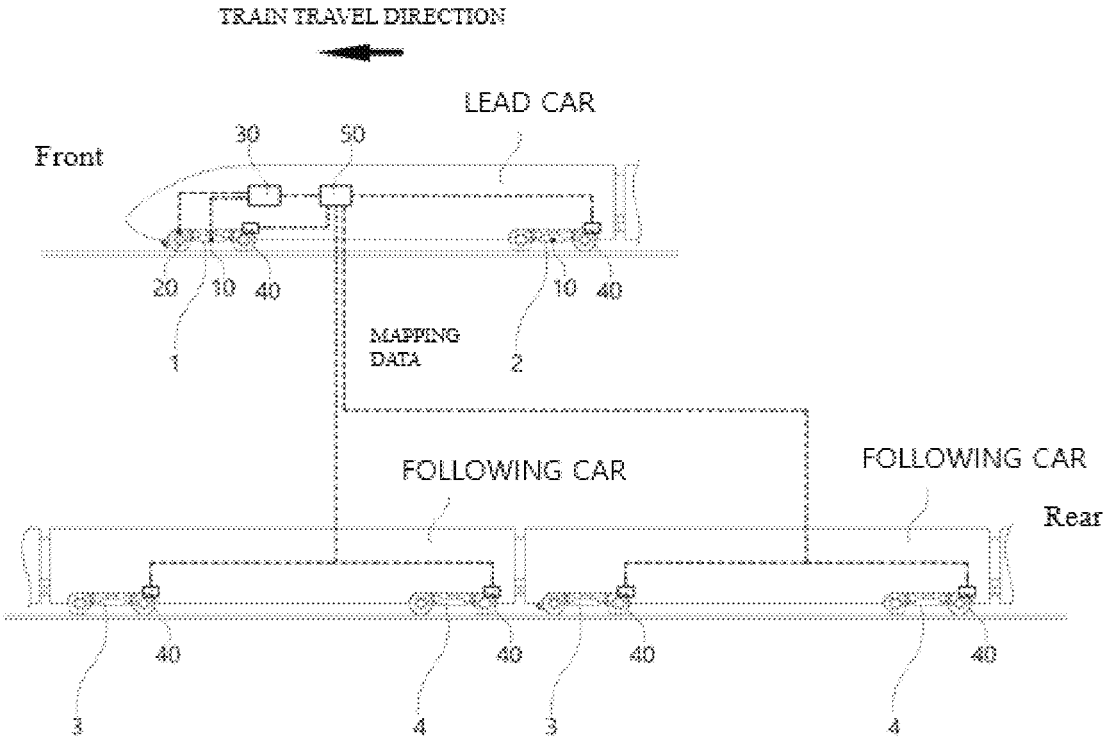
FIG. 5 is a diagram showing a configuration of a system for estimating a track curvature for active steering control of railcars according to the present invention.
Figure 6:
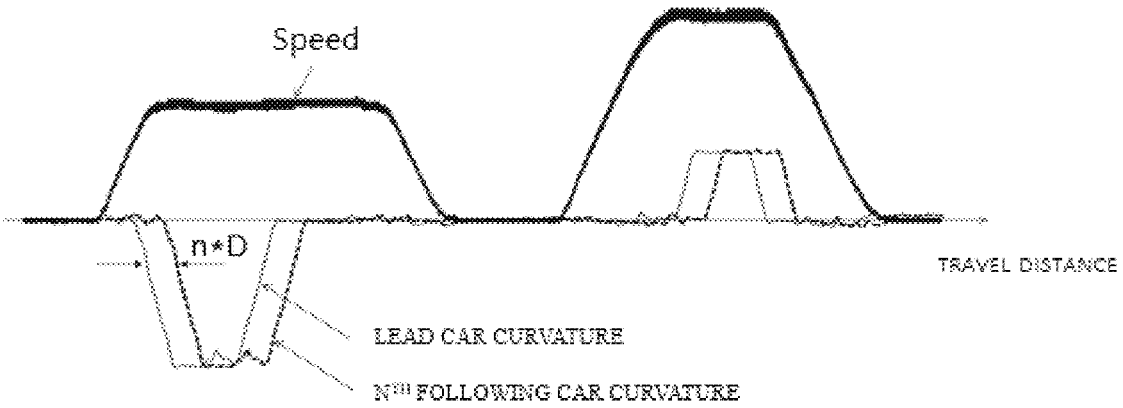
FIG. 6 is a graph illustrating an example of utilizing curvature radius data of a curved runway track acquired from a lead car as curvature radius data of a curved runway track for active steering control of a following car according to a distance delay method of the present invention.

Therefore, as shown in FIG. 5, each of two railcars at the both ends of a train in a longitudinal direction includes displacement sensors 10 for measuring a relative displacement between a front bogie 1 and a rear bogie 2 to acquire a curvature radius of a track, a speed sensor 20 for measuring a speed of the train, a calculation unit 30 for calculating the track curvature radius on the basis of the data measured by the displacement sensors 10 and the speed sensor 20, and a data mapping unit 50 for mapping the curvature radius data calculated by the calculation unit 30 to locations of following cars in accordance with lengths of the railcars.

Figure 4A:
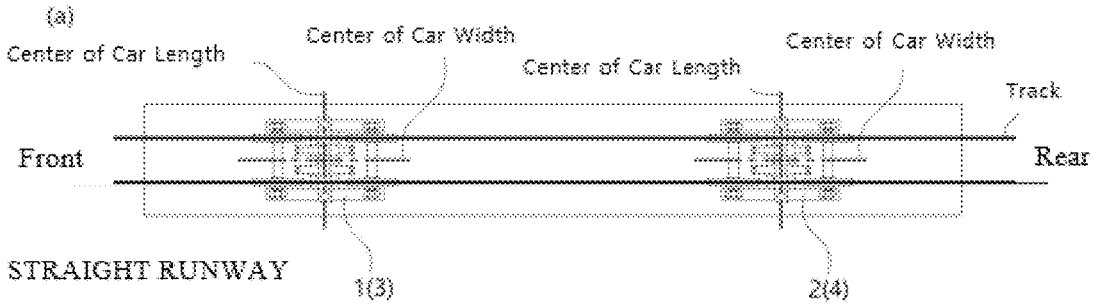
FIG. 4(*a*), FIG. 4(*b*) are a set of diagrams showing changes in arrangement angles of front and rear bogies of a railcar moving along straight runway and curved runway tracks.

The front bogie 1 and the rear bogie 2 in a travel direction are connected to a lower part of a body of a lead car to be rotatable to lateral sides of the car body. Accordingly, as shown in FIG. 4, when the train enters a curved runway, centers of the front and rear bogies 1 and 2 in the width direction rotate toward a center of a curvature radius of the track.

Active steering control units 40 control rotation angles of the front and rear bogies 1 and 2 in accordance with a track curvature radius measured by the displacement sensors 10 and the calculation unit 30, improving travel stability of the train entering a curved runway.

Figure 4B:
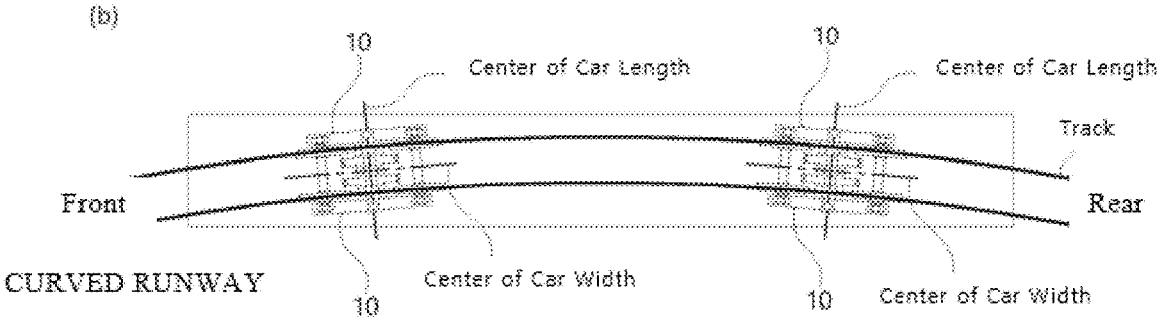

The displacement sensors 10 are installed on the front bogie 1 and the rear bogie 2. As shown in FIG. 4B, the displacement sensors 10 measure a car-front-back-direction relative displacement between the front bogie 1 and the rear bogie 2 between which a relative angle is formed when the front bogie 1 and the rear bogie 2 rotate to a lateral side of the car body upon entering a curved sectional track.

(1) First Exemplary Embodiment of Measuring Track Curvature Radius

In the first exemplary embodiment of measuring a track curvature radius, the calculation unit 30 receives displacement data measured by the displacement sensors 10 of the front bogie 1 and the rear bogie 2 and estimates a front-back-direction relative angle between the front bogie 1 and the rear bogie 2 of the lead car from the measured relative displacement.

Figure 10A:
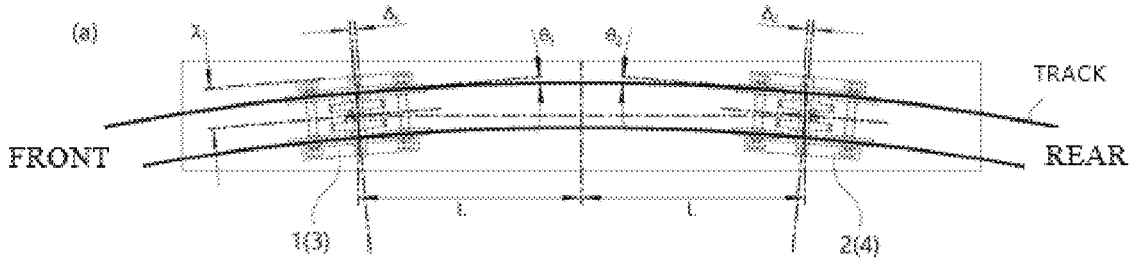
FIG. 10(*a*), FIG. 10(*b*) and FIG. 11 are diagrams illustrating various values applied to a curvature radius estimation equation according to a first exemplary embodiment of a track curvature estimation system of the present invention.
Figure 10B:
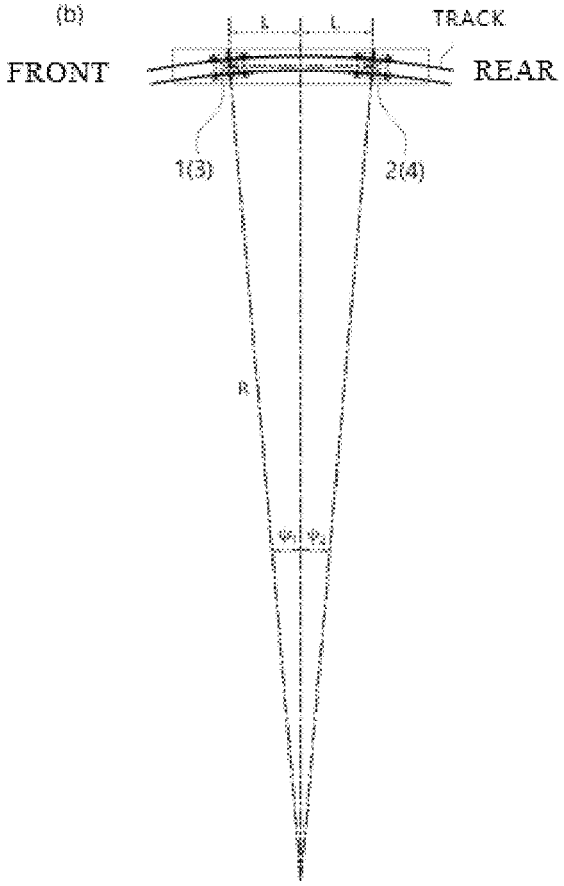
Figure 11:
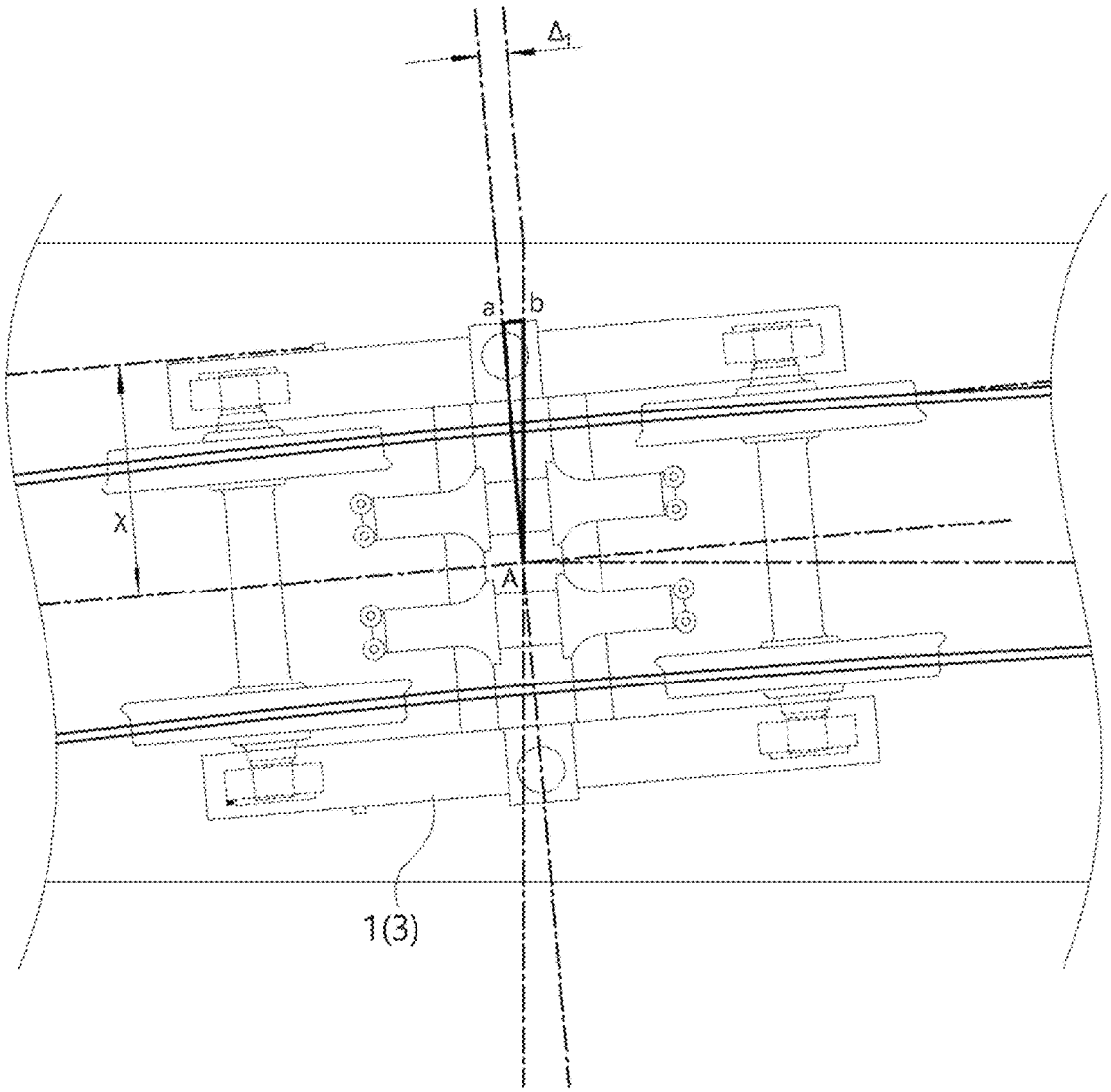

As shown in FIGS. 10 and 11, the front bogie 1 and the rear bogie 2 rotate at angles of $\theta_1$ and $\theta_2$ with respect to a curvature radius center point of each track. There is a separation distance of 2L between a center of the front bogie 1 and a center of the rear bogie 2 at which rotation axes are formed.

To increase the accuracy of measuring a relative displacement through the displacement sensors 10 by increasing a relative displacement between the front and rear bogies 1 and 2 during a travel on a curved runway, the displacement sensors 10 are installed at positions at a certain distance from width-direction centers of the front and rear bogies 1 and 2 in a lateral direction, and there is a separation distance of x between the installation positions of the displacement sensors 10 and the width-direction centers of the front and rear bogies 1 and 2.

When the front bogie 1 rotates on a curved runway, a width-direction center line of the car body on which a rotation axis of the front bogie 1 is present and a length-direction center line of the front bogie 1 are spaced apart by $\Delta_1$ in car front-back directions on a bogie surface on which the displacement sensor 10 is installed.

Also, when the rear bogie 2 rotates on a curved runway, the width-direction center line of the car body on which a rotation axis of the rear bogie 2 is present and a length-direction center line of the rear bogie 2 are spaced apart by $\Delta_2$ in the car front-back directions on a bogie surface on which the displacement sensor 10 is installed, and the sum of $\Delta_1$ and $\Delta_2$ is defined to be $\Delta$.

From L, x, and $\Delta$ defined above, a curvature radius R of the track on which the lead car passes may be estimated in accordance with the equation $$R = \frac{2Lx}{\Delta}.$$

When the center of the front bogie 1 and a track curvature radius center are connected with a virtual line segment and a center of the distance between the centers of the front and rear bogies 1 and 2 and the track curvature radius center are connected with a virtual line segment, an angle of $\psi_1$ is formed between the center of the front bogie 1 and the center of the distance between the centers of the front and rear bogies 1 and 2 with respect to the track curvature radius center.

Also, when the center of the rear bogie 2 and the track curvature radius center are connected with a virtual line segment and the center of the distance between the centers of the front and rear bogies 1 and 2 and the track curvature radius center are connected with a virtual line segment, an angle of $\psi_2$ is formed between the center of the rear bogie 2 and the center of the distance between the centers of the front and rear bogies 1 and 2 with respect to the track curvature radius center.

Assuming that the front and rear bogies 1 and 2 are positioned perpendicularly to the virtual line segments (radial positions), $\theta_1$ and $\theta_2$ are the same, and $\psi_1$ and $\psi_2$ are the same.

Due to the principle of triangle similarity, $\theta_1$ and $\psi_1$ are the same, and $\theta_2$ and $\psi_2$ are the same.

As shown in FIG. 11, since the displacement sensor 10 is installed on a bogie surface with a distance of $\Delta_1$ in a car front-back direction, a virtual triangle Aab (A is a center of rotation of the front bogie) is formed, and the triangle Aab has a similar shape to a triangle AOP (O: a center of the curvature radius of the track, and P: a center of a separation distance between the centers of the front and rear bogies).

Accordingly, equations $$\frac{\Delta_1}{x} = \theta_1, \frac{\Delta_2}{x} = \theta_2$$

and $\theta_1=\theta_2$ are established, and the turn angles $\psi_1$ and $\psi_2$ may be expressed as an equation $$\psi_1 = \psi_2 = \frac{L}{R}.$$

Therefore, $$2\psi = \theta_1 + \theta_2 = \frac{\Delta_1}{x} + \frac{\Delta_2}{x} = \frac{2L}{R}$$

holds, and the curvature radius R of the track on which the lead car passes can be estimated using an equation $$R = \frac{2Lx}{\Delta}.$$

(2) Second Exemplary Embodiment of Measuring Track Curvature Radius

In the second exemplary embodiment of measuring a track curvature radius, the displacement sensor 10 is installed at a rotation axis of the front bogie 1, and the displacement sensor 10 is a Global Positioning System (GPS) receiver such that a GPS signal is received through the displacement sensor 10 to measure a travel path and a travel speed of the rotation axis of the front bogie 1 running on a curved sectional track.

The displacement sensor 10 is not installed in the rear bogie 2, and a travel path of the center of the rear bogie 2 is estimated on the basis of the travel path of the center of the front bogie 1 measured by the displacement sensor 10 and a separation distance between the centers of the front bogie 1 and the rear bogie 2 of the lead car.

Figure 12A:
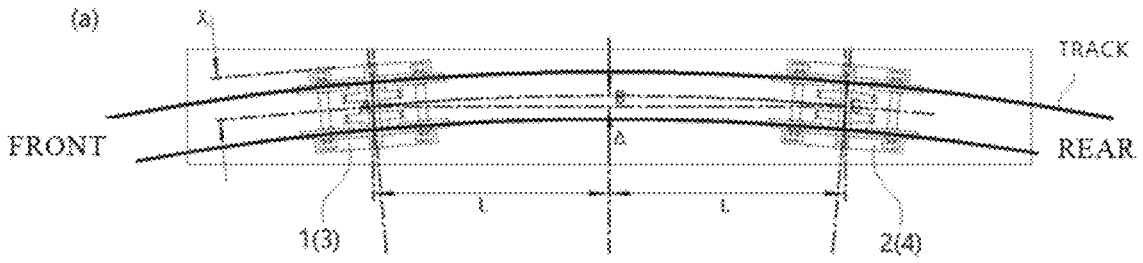
FIG. 12(*a*), FIG. 12(*b*) are a set of diagrams illustrating various values applied to a curvature radius estimation equation according to a second exemplary embodiment of a track curvature estimation system of the present invention.
Figure 12B:
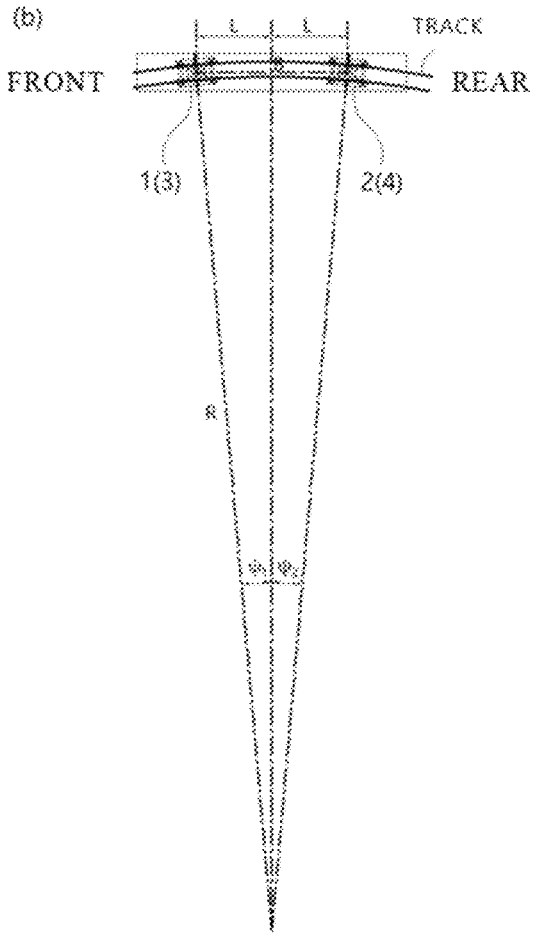

Assuming that the front and rear bogies 1 and 2 are positioned perpendicularly to virtual line segments between the track and the center of curvature (radial positions), half the separation distance between the centers of the front bogie 1 and the rear bogie 2 at which the rotation axes are formed is L as shown in FIG. 12.

When a maximum separation distance between a trajectory of the travel path of the center of the front bogie 1 running along a curved runway of a track and a virtual line segment connecting the front bogie center and the rear bogie center is defined to be Δ, a separation distance between a center point B of an arc $\widetilde{ABC}$ (A: a rotation axis of the front bogie, and C: a rotation axis of the rear bogie) and the separation distance between the centers of the front bogie 1 and the rear bogie 2 is Δ.

The triangle AOP (O: the center of the curvature radius of the track, and P: the center of the separation distance between the centers of the front and rear bogies) satisfies ( $\overline{PO})^2=(\overline{AP})^2+(\overline{AO})^2$ in accordance with the Pythagorean theorem. Δ is obtained by subtracting a separation distance between the virtual line segment AC and the curvature radius center O from the curvature radius R and thus may be expressed as the following equation.

$$\Delta = R - \sqrt{(R^2 - L^2)}$$

Therefore, the curvature radius of the track on which the lead car passes can be estimated using an equation $$R = \frac{\Delta^2 + L^2}{2\Delta}.$$

In addition, when the lead car passes through the curved runway and then following cars pass through the same curved runway, it is necessary to accurately find locations of the following cars moving along the lead car to estimate the track curvature radius measured at the lead car as a curvature radius of the curved runway on which the following cars pass.

Figure 7:
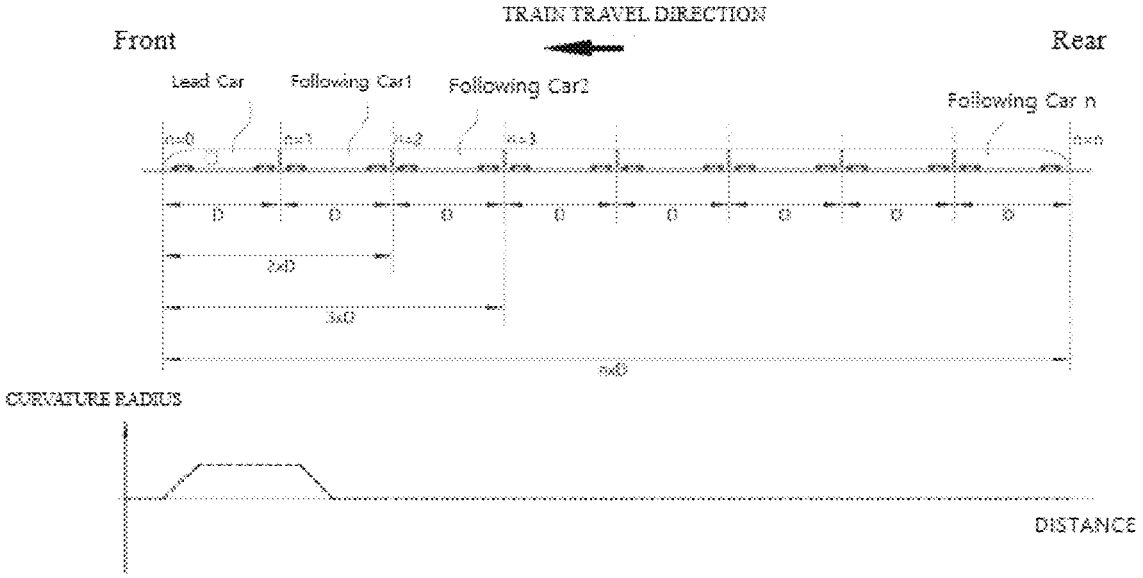
FIG. 7 is a diagram showing a positional relationship between a lead car and following cars in a system for estimating a track curvature for active steering control of railcars according to the present invention.

The following cars constituting the train have the same travel-direction length. Accordingly, when a following car connected to the rear end of the lead car is defined as following car 1, a following car connected to the rear end of following car 1 is defined as following car 2, and an $n^{th}$ following car connected to the rear end of the lead car is defined as following car n as shown in FIG. 7, a location of the $n^{th}$ following car based on a car length of D becomes D×n.

According to this, when the lead car passes a specific point of a curved sectional track, a following car connected to an $n^{th}$ portion behind the lead car passes a point that is a distance of D×n behind the specific point, and when the following car connected to the $n^{th}$ position behind the lead car passes the same point of the curved sectional track, the lead car moves ahead by a distance of D×n.

Therefore, a curvature radius of the curved runway track on which the $n^{th}$ following car passes can be estimated to be the same as the curvature radius of the curved runway track on which the lead car moving a distance of D×n ahead of the $n^{th}$ following car passes.

According to the related art, to utilize curvature radius data of a curved runway track acquired from a lead car as curvature radius data of the curved runway track for active steering control of following cars, a curvature radius of a curved sectional track on which a following car passes is estimated on the basis of a time difference (or a delayed time) between a lead car and the following car.

Figure 2:
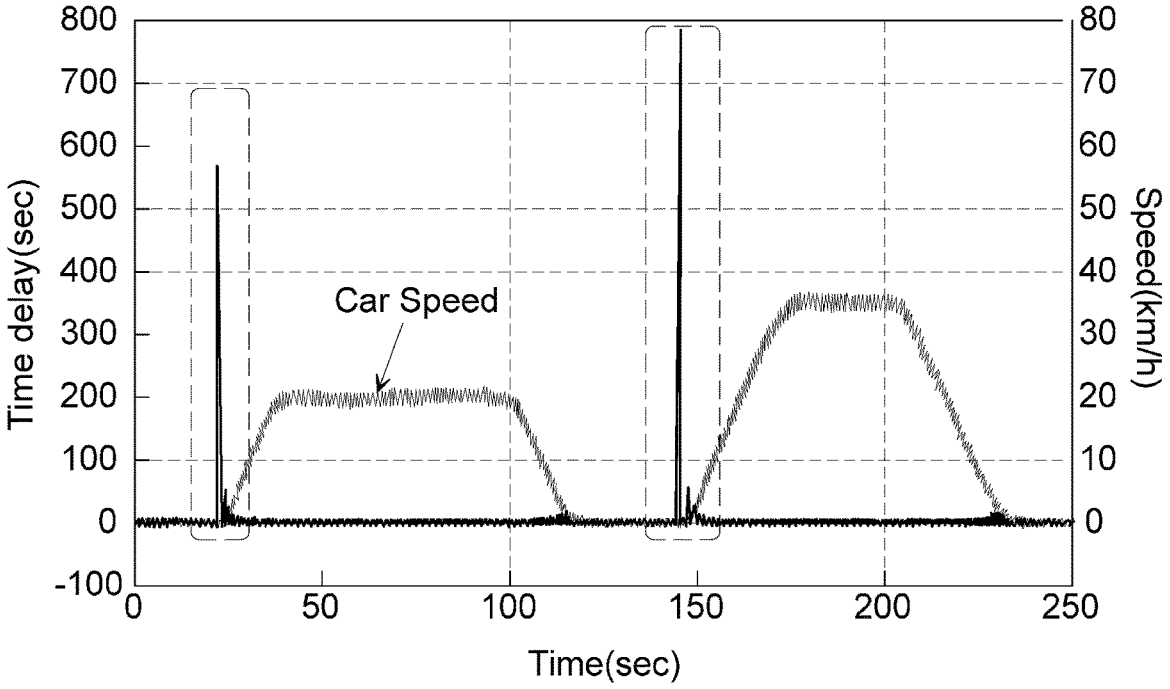

In the case of estimating a curvature radius of a track using a time delay according to the related art, as shown in FIG. 2, a time delay value for estimating a curvature radius of a curved sectional track is a constant while a travel speed of a train is uniformly maintained, but a time delay value drastically changes while the train departs or stops.

Since a speed of a railcar and a delayed time have a relationship of Time delay=travel distance/speed, when a speed of a train approaches 0 during a departure or stop process, a time delay excessively increases as shown in broken-line boxes of FIG. 2. Since the travel speed of the train changes in real time, a time delay is not a constant but a variable, and a time delay value for delayed application of a curvature radius estimation value for a curved sectional track to a following car becomes unstable.

Due to the instability of a time delay value for delayed application of a curvature radius estimation value for a curved sectional track to a following car, when active steering control units of the following car control travel-direction rotation angles of front and rear bogies 3 and 4 on the basis of the track curvature radius estimation value, a delay error may occur between the track curvature radius estimation value and an actual curvature radius of the curved runway track on which the following car is running.

When the delay error occurs, travel-direction control angles of the front and rear bogies 3 and 4 are not consistent with the actual curvature radius of the curved runway track, and travel stability may be degraded. When there is a large inconsistency between the travel-direction control angles of the front and rear bogies 3 and 4 and the track curvature radius, accidents such as derailment and the like may occur.

On the other hand, according to an exemplary embodiment of the present invention, a curvature radius of a curved sectional track on which an $n^{th}$ following car passes is estimated using a distance delay method based on relative positions of a lead car and a following car, and thus it is possible to prevent an error in the delayed application of a curvature radius estimation value caused when a train departs or stops.

When a curvature radius of a track measured at a lead car is estimated as a curvature radius of a curved runway on which an $n^{th}$ following car passes, a travel speed of the lead car is measured through the speed sensor 20 to accurately measure a distance delay value between the lead car and the $n^{th}$ following car.

In the first exemplary embodiment of measuring a track curvature radius, the speed sensor 20 may be a tachometer installed on a wheelset of the front bogie 1 or the rear bogie 2. In the second exemplary embodiment of measuring a track curvature radius, when a GPS signal is received through the displacement sensor 10, travel path and travel speed data of the front bogie 1 can be simultaneously acquired, and thus the displacement sensor 10 replaces the speed sensor 20.

The speed sensor 20 which is a tachometer according to the first exemplary embodiment of measuring a track curvature radius may be installed in each of the front bogie 1 and the rear bogie 2, and the speed sensors 20 installed on the front bogie 1 and the rear bogie 2 measure a travel speed of the railcar from the number of rotations of a wheel.

To restore a travel location of a car body on a track and improve travel safety, wheels of railcars have threads with a tapered cross-sectional shape that increases in diameter outward in the width direction of the railcars. Depending on the wheel tread positions in contact with rails of a track, diameters of wheels change, which may cause an error in the speed measured by the tachometer.

Therefore, in the case of calculating a travel distance of the lead car through the calculation unit 30, an average of a speed measured by the speed sensor 20 of the front bogie 1 and a speed measured by the speed sensor 20 of the rear bogie 2 is set as speed data to calculate a travel distance such that accuracy of the calculated travel distance can be improved.

The data mapping unit 50 specifies D×n that is an $n^{th}$ following car's location in accordance with the car length D on the basis of the travel distance calculated by the calculation unit 30, maps the distance delay value to track curvature radius measurement data of the lead car using the specified interval data of D×n to generate track curvature radius estimation value data of the $n^{th}$ following car, and then transmits the mapped data to active steering control units 40 that controls steering of the front and rear bogies 1, 2, 3, and 4 of the lead car and the following car.

Each of the front and rear bogies 1 and 2 or 3 and 4 of the lead car or the following car receiving the track curvature radius estimation value data from the data mapping unit 50 selects a track curvature radius estimation value to which a distance delay value is applied in accordance with an n value based on a connected position of the corresponding car.

Figure 9:
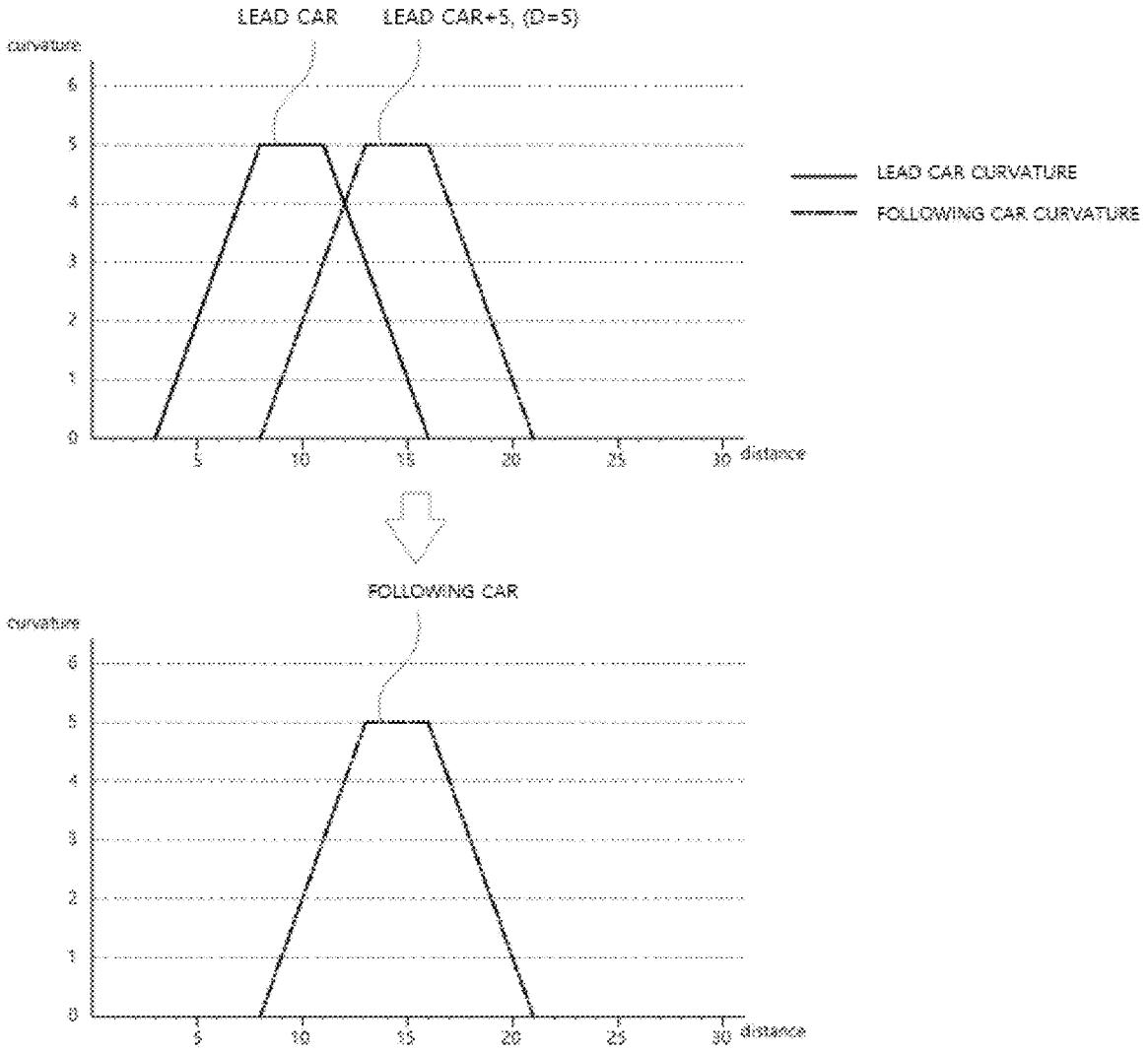

As shown in FIGS. 8 and 9, the active steering control units 40 of the front and rear bogies 1 and 2 of the preceding car performs steering control on the basis of mapping data corresponding to the lead car, and the active steering control units 40 of the front and rear bogies 3 and 4 of the following car connected to the rear end of the preceding car performs steering control on the basis of mapping data delayed by a distance D (D=5) from the lead car.

Here, the preceding car is not the lead car but an adjacent car connected to the front end of the following car.

Figure 13A:
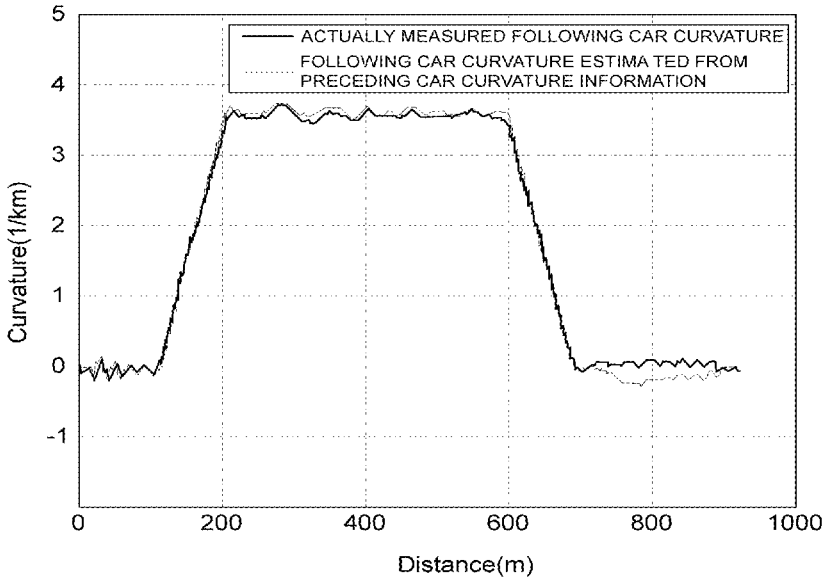
FIG. 13(*a*), FIG. 13(*b*) are a set of graphs showing a distance delay value measured when curvature radius data of a curved runway track is acquired according to the present invention and a time delay value measured in accordance with a railcar travel speed when curvature radius data of a curved runway track is acquired according to the related art.
Figure 13B:
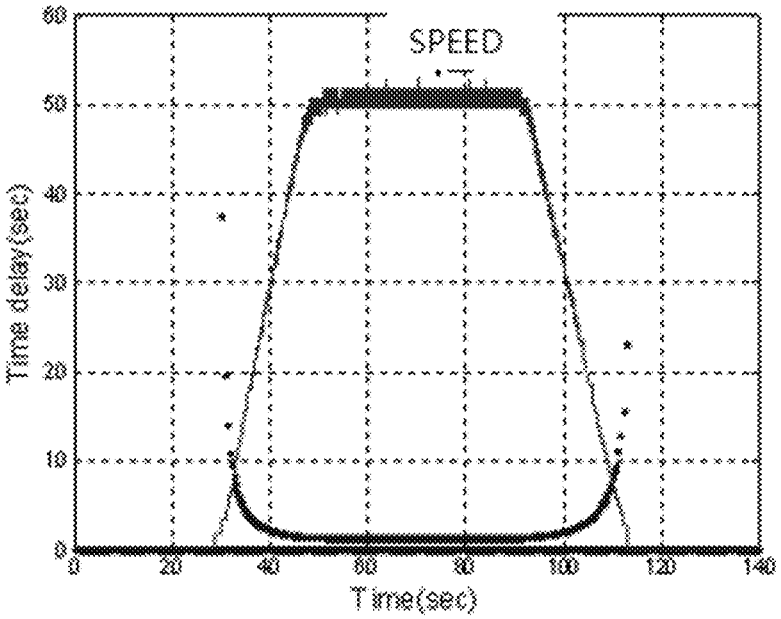

FIG. 13B shows a speed of a train (red line) and a time delay value (blue line) in the case of estimating a track curvature radius according to a time delay method of the related art. In FIG. 13B, it is seen that a time delay value drastically increases during time periods around 30 seconds and 110 seconds.

FIG. 13A shows a graph for comparing mapping data (red line) for the active steering control unit 40 of a preceding or following car to perform steering control according to the present invention and track curvature radius data (blue line) actually measured by the displacement sensor 10 and the calculation unit 30 installed in the following car. In FIG. 13A, it is seen that the mapping data is substantially the same as the actually measured data.

Figure 14:
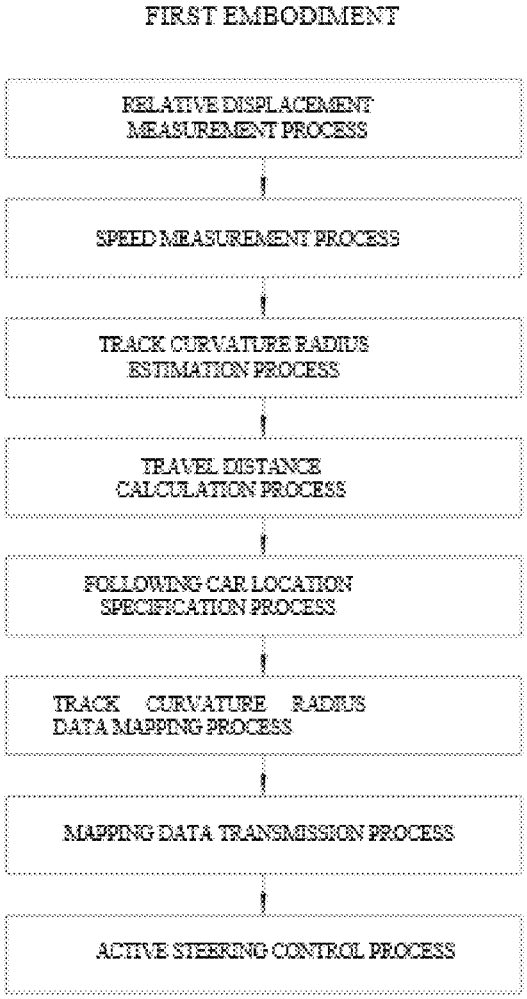
FIGS. 14 and 15 are flowcharts illustrating a method of estimating a track curvature for active steering control of railcars according to the first and second exemplary embodiments of the present invention.
Figure 15:
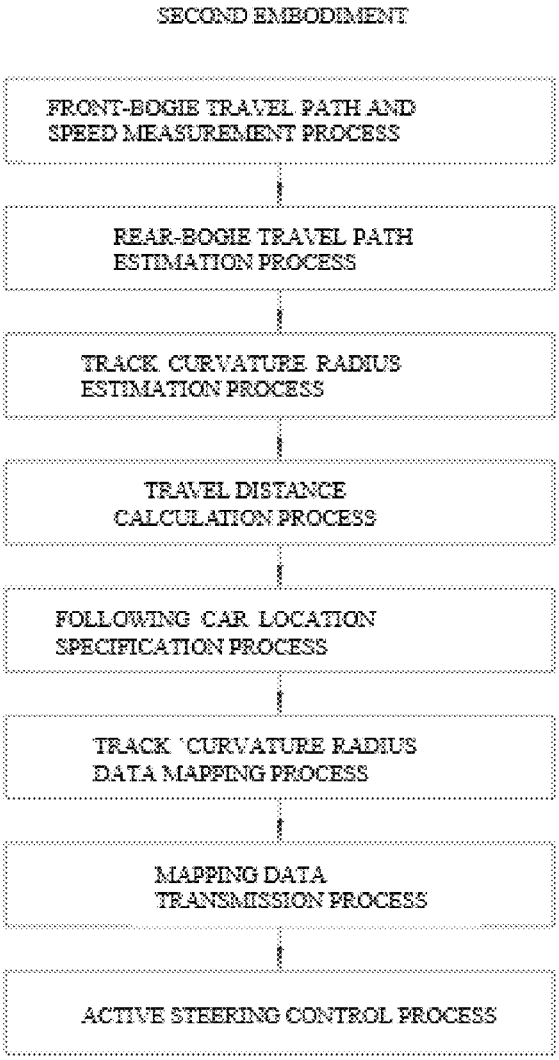

A track curvature estimation method of the track curvature estimation system of the present invention configured as described above is performed as shown in FIG. 14 or 15 according the first or second exemplary embodiment.

(1) First Exemplary Embodiment of Measuring Track Curvature Radius

In a relative displacement measurement process, the displacement sensors 10 installed on the front bogie 1 and the rear bogie 2 of the lead car measure a relative displacement between the front bogie 1 and the rear bogie 2 entering a curved sectional track.

In a speed measurement process, the speed sensor 20 measures a travel speed of the lead car. The speed measurement process is performed at the same time as the relative displacement measurement process to improve accuracy of a distance delay value of mapping data which is generated later for the active steering control unit 40 of a preceding or following car to perform active steering control.

In a track curvature radius estimation process, a relative angle between the front and rear bogies 1 and 2 of the lead car is estimated from the displacement data received from the displacement sensors 10, and then an estimation value of a track curvature radius R is calculated using an equation $$R = \frac{2Lx}{\Delta}.$$

In a travel distance calculation process, the calculation unit 30 calculates a travel distance of the lead car on the basis of the speed data measured by the speed sensor 20. The travel distance calculation process is performed at the same time as the track curvature radius estimation process to improve accuracy of a distance delay value of mapping data which is generated later for the active steering control unit 40 of a preceding or following car to perform active steering control.

In a following car location specification process, the data mapping unit 50 generates location specification data for specifying D×n which is a location of an $n^{th}$ following car in accordance with a car length of D on the basis of the travel distance calculated in the travel distance calculation process.

In a track curvature radius data mapping process, the location specification data generated in the following car location specification process is mapped to the track curvature radius estimation value data measured in the track curvature radius estimation process to generate mapping data having separate track curvature radius estimation value data for following cars' specified locations at intervals of D×n.

In a mapping data transmission process, the mapping data generated in the track curvature radius data mapping process is transmitted to active steering control units installed in the front and rear bogies 1, 2, 3, and 4 of the railcars. In an active steering control process, mapping data corresponding to the location of the following car to which the active steering control units 40 belong is selected from the received mapping data to separately control the active steering control units 40 of the corresponding car on the basis of the mapped track curvature estimation value.

(2) Second Exemplary Embodiment of Measuring Track Curvature Radius

In a front-bogie travel path and speed measurement process, the displacement sensor 10 which is a GPS receiver installed at a center of the front bogie 1 of the lead car measures a travel path and travel speed of the center of the front bogie 1 running on a curved sectional track in real time.

In a rear-bogie travel path estimation process, the calculation unit 30 estimates a travel path of a center of the rear bogie 2 on the basis of the travel path of the front bogie 1 acquired in the front-bogie travel path and speed measurement process and a separation distance between the centers of the front and rear bogies 1 and 2.

After the estimation of the travel path of the rear bogie 2 is completed, in a track curvature radius estimation process, an estimation value of a track curvature radius R is calculated using an equation $$R = \frac{\Delta^2 + L^2}{2\Delta}.$$

In a travel distance calculation process, the calculation unit 30 calculates a travel distance of the lead car on the basis of the speed data measured by the displacement sensor 10, unlike in the first exemplary embodiment in which the speed sensor 20 is additionally used.

A following car location specification process to an active steering control process that are performed thereafter are the same as described in the first exemplary embodiment.

According to the present invention, in the case of estimating a curvature radius of a curved runway track measured at a preceding car in a train as curvature radius data of the curved runway track for active steering control of a following car to reduce the cost of installing a track curvature detection device for active steering control, curvature radius estimation data is applied with delay between preceding and following cars using an inter-car distance delay method. Therefore, when active steering control is performed on a following car, it is possible to prevent a delay error from an actual curvature radius of a curved runway track on which the following car is running.

According to the present invention, when active steering control is performed on a following car on the basis of curvature radius estimation data measured at a preceding car, it is possible to prevent a delay error between an actual curvature radius and curvature radius estimation data of a curved runway track on which the following car is running. Accordingly, the travel stability of trains is improved, and it is possible to prevent accidents, such as derailment and the like, from being caused by failure of active steering control.

Although exemplary embodiments of the present invention have been described above, those of ordinary skill in the art to which the present invention pertains will appreciate that the present invention may be implemented in other specific forms without departing from the technical spirit or essential features thereof.

Therefore, the above-described embodiments are to be construed as illustrative rather than restrictive in all aspects. The scope of the present invention described in the above detailed description is presented in the following claims, and all modifications or variations derived from the meaning and scope of the claims and the equivalent concepts thereof fall within the scope of the present invention.

What is claimed is:

1. A system for estimating a track curvature for active steering control of railcars of a train comprising a lead car and one or more following cars, the system comprising:

displacement sensors installed on a front bogie of the lead car in the train's travel direction and on a rear bogie of the lead car, the displacement sensors being configured to measure a car-front-back-direction relative displacement between the front bogie and the rear bogie between which a relative angle is formed due to a curved sectional track;

speed sensors configured to measure a travel speed of the lead car;

a calculation unit configured to receive displacement data measured by the displacement sensors, estimate a front-back-direction relative angle between the front bogie and the rear bogie of the lead car from the measured relative displacement, calculate an estimation value of a track curvature radius R using an equation R=2Lx/Δ, wherein 2L is a distance between a center of the front bogie and a center of the rear bogie, x is a separation distance of each of the displacement. sensors from the center of a respective one of the front bogie and the rear bogie in a car width direction, and Δ is a sum of a separation distance A1 of the displacement sensor installed on the front bogie from the center of the front bogie in a car front-back direction and a separation distance $\Delta_2$ of the displacement sensor installed on the rear bogie from the center of the rear bogie in the car front-back direction, and calculate a travel distance of the lead car on the basis of speed data measured by the speed sensors;

active steering control units installed in a front bogie and a rear bogie of each of the railcars of the train, each active steering control unit being configured to control steering of a corresponding one of the front bogie and the rear bogie on the basis of a mapped track curvature radius estimation value; and a data mapping processor connected to the calculation unit and the active steering control units and configured to receive the estimation value of the track curvature radius and the travel distance from the calculation unit, specify, for an nth following car among the one or more following cars, a location delayed from the lead car by a distance of D×n in accordance with a car length of D, where n is a positive integer indicating an order of the nth following car rearward from the lead car, generate mapping data by associating the estimation value of the track curvature radius calculated by the calculation unit with the specified location of the nth following car at intervals of D×n, and transmit the mapping data including the mapped track curvature radius estimation value to the active steering control units of the one or more following cars.

2. The system of claim 1, wherein the speed sensors measure the travel speed of the lead car from numbers of wheel rotations of the front bogie and the rear bogie of the lead car, and the calculation unit uses an average of a speed measured by the speed sensor of the front bogie and a speed measured by the speed sensor of the rear bogie as the speed data to calculate the travel distance of the lead car.

3. A method of estimating a track curvature for active steering control of railcars of a train comprising a lead car and one or more following cars, the method comprising:

a relative displacement measurement process in which displacement sensors installed on a front bogie and a rear bogie of the lead car in the train's travel direction measure a car-front-back-direction relative displacement between the front bogie and the rear bogie between which a relative angle is formed due to a curved sectional track;

a speed measurement process in which speed sensors measure a travel speed of the lead car;

a track curvature radius estimation process in which a calculation unit estimates a front-back-direction relative angle between the front bogie and the rear bogie of the lead car from displacement data received from the displacement sensors and then calculates an estimation value of a track curvature radius R using an equation $R=2Lx/\Delta$, wherein 2L is a distance between a center of the front bogie and a center of the rear bogie, x is a separation distance of each of the displacement sensors from the center of a respective one of the front bogie and the rear bogie in a car width direction, and $\Delta$ is a sum of a separation distance $\Delta_1$ of the displacement sensor installed on the front bogie from the center of the front bogie in a car front-back direction and a separation distance $\Delta_2$ of the displacement sensor installed on the rear bogie from the center of the rear bogie in the car front-back direction;

a travel distance calculation process in which the calculation unit calculates a travel distance of the lead car on the basis of speed data measured by the speed sensors;

a following car location specification process in which a data mapping processor specifies, for an nth following car among the one or more following cars, a location delayed from the lead car by a distance of D×n in accordance with a car length of D, where n is a positive integer indicating an order of the nth following car rearward from the lead car, on the basis of the travel distance calculated by the calculation unit;

a track curvature radius data mapping process of generating mapping data by associating the estimation value of the track curvature radius calculated by the calculation unit with the specified location of the nth following car at intervals of D×n;

a mapping data transmission process of transmitting the mapping data including the mapped track curvature radius estimation value to active steering control units installed in a front bogie and a rear bogie of each of the railcars of the train; and an active steering control process of separately controlling the active steering control units of each of the railcars on the basis of the mapped track curvature radius estimation value.

4. The method of claim 3, wherein, in the speed measurement process, the speed sensors measure the travel speed of the lead car from numbers of wheel rotations of the front bogie and the rear bogie of the lead car, and in the travel distance calculation process, the calculation unit calculates the travel distance of the lead car on the basis of travel speed data acquired from an average of a speed measured by the speed sensor of the front bogie and a speed measured by the speed sensor of the rear bogie.

* * * * *